US006325420B1

(12) United States Patent
Zhang et al.

(10) Patent No.: US 6,325,420 B1
(45) Date of Patent: Dec. 4, 2001

(54) METHOD FOR EMBEDDING NON-INTRUSIVE ENCODED DATA IN PRINTED MATTER AND SYSTEM FOR READING SAME

(75) Inventors: Xintong Zhang, Brookline; Kenneth G. Berquist, Andover, both of MA (US)

(73) Assignee: Inspectron Corporation, Chelmsford, MA (US)

( * ) Notice: Subject to any disclaimer, the term of this patent is extended or adjusted under 35 U.S.C. 154(b) by 0 days.

(21) Appl. No.: 09/135,520

(22) Filed: Aug. 17, 1998

(51) Int. Cl.[7] ..... B42D 15/00
(52) U.S. Cl. ..... 283/70; 283/67
(58) Field of Search ..... 283/72, 67, 70, 283/74, 79, 91, 93, 113, 901; 101/2, 483, 484, 485, 486, DIG. 46

(56) References Cited

U.S. PATENT DOCUMENTS

| | | | |
|---|---|---|---|
| 1,675,769 | 7/1928 | Smith . | |
| 1,817,171 | 4/1931 | Smith . | |
| 3,607,524 | 9/1971 | Kuhns | 156/220 |

(List continued on next page.)

FOREIGN PATENT DOCUMENTS

| | | |
|---|---|---|
| 0 551 016 A1 | 7/1993 | (EP) . |
| 600646 | 6/1994 | (EP) . |
| 0 651 554 A1 | 5/1995 | (EP) . |
| 0751 475 A2 | 1/1997 | (EP) . |
| 910032 | 4/1999 | (EP) . |
| WO 9520291 | 7/1995 | (WO) . |
| WO 99/13391 | 3/1999 | (WO) . |

OTHER PUBLICATIONS

Berghel et al. Protection ownership rights through digital watermarking, Internet Kiosk, Jul. 1996 pp. 101–103.
Cox et al. A Secure, Imperceptable yet Perceptually Salient, Spread Spectrum Watermark for Multimedia, 1996:pp. 192–197, XP 000613940 ISBN # 0–7803–3268–7.
J. F. Delaigle et al. Digital Watermarking, XP 000604065, 1996 SPIE vol. 2659, pp. 99–110.
J. J. K. O Raunaidh et al. Watermarking digital images for copyright protection, IPA95 Special Section XP 000613938, IEEE Proc–Vis. Image Signal Process, Aug. 1996 vol. 143(4).
Kiyoshi Tanaka et al. A Digital Signature Scheme on a Document for MH Facsimile Transmission, Electronics and Communications in Japan, 1991 vol. 74(8) pp. 30–36.
Maxwell T. Sandford II et al. The Data Embedding Method, 1995, pp. 226–259, XP 000601271.

*Primary Examiner*—Willmon Fridie, Jr.
(74) *Attorney, Agent, or Firm*—Lahive & Cockfield, LLP

(57) ABSTRACT

Printed matter has printed informational content. This refers to the content of a given document which is relevant to the intended reviewer, e.g., the printed text of the letter or pictures. According to the invention, the printed matter also, however, comprises a print control symbol. This symbol is located at a predetermined position on the printed matter, which is separated from the printed informational content. The print control symbol is hidden such that it is not apparent to a reviewer of the printed matter and encodes information concerning the printed matter such as sequencing information, which is relevant to the printing system during printing and mailing, for example.

30 Claims, 5 Drawing Sheets

U.S. PATENT DOCUMENTS

| | | | |
|---|---|---|---|
| 4,184,700 | 1/1980 | Greenaway | 283/6 |
| 4,239,261 | 12/1980 | Richardson | 283/21 |
| 4,243,734 | 1/1981 | Dillon | 430/8 |
| 4,360,728 | 11/1982 | Drexler | 235/462 |
| 4,504,084 | 3/1985 | Jauch | 283/94 |
| 4,504,357 | 3/1985 | Holbein et al. | 162/123 |
| 4,627,819 | 12/1986 | Burrows | 434/337 |
| 4,790,566 | 12/1988 | Boissier et al. | 283/91 |
| 4,883,291 | 11/1989 | Robertson | 283/117 |
| 4,908,873 | 3/1990 | Philibert et al. | 382/34 |
| 5,018,830 | 5/1991 | Krop | 350/105 |
| 5,031,214 | 7/1991 | Dziewit et al. | 380/23 |
| 5,080,479 | 1/1992 | Rosenberg | 352/92 |
| 5,134,669 | 7/1992 | Keogh et al. | 382/61 |
| 5,140,650 | 8/1992 | Casey et al. | 382/61 |
| 5,149,169 | 9/1992 | Mowry, Jr. et al. | 283/93 |
| 5,153,418 | 10/1992 | Batterman et al. | 235/494 |
| 5,178,418 | 1/1993 | Merry et al. | 283/73 |
| 5,189,292 | 2/1993 | Batterman et al. | 235/494 |
| 5,429,392 | 7/1995 | Loving | 283/72 |
| 5,444,779 | 8/1995 | Daniele | 380/3 |
| 5,449,895 | 9/1995 | Hecht et al. | 235/494 |
| 5,467,169 | 11/1995 | Morikawa | 355/201 |
| 5,530,759 | 6/1996 | Braudaway et al. | 380/54 |
| 5,563,401 | 10/1996 | Lemelson | 235/494 |
| 5,568,550 | 10/1996 | Ur | 380/3 |
| 5,572,010 | 11/1996 | Petrie | 235/494 |
| 5,577,774 | 11/1996 | Morikawa et al. | 283/93 |
| 5,636,957 * | 6/1997 | Hefty | 283/67 X |
| 5,668,636 | 9/1997 | Beach et al. | 358/296 |
| 5,684,885 | 11/1997 | Cass et al. | 382/100 |
| 5,708,717 | 1/1998 | Alasia | 380/51 |
| 5,748,763 | 5/1998 | Rhoads | 382/115 |
| 5,752,152 | 5/1998 | Gasper et al. | 399/366 |
| 5,764,774 | 6/1998 | Liu | 380/49 |
| 5,765,874 * | 6/1998 | Chanenson et al. | 285/67 |
| 6,072,871 | 6/2000 | Ur | 380/51 |

* cited by examiner

| | | | | |
|---|---|---|---|---|
| 1 | 1 | 0 | 0 | 1 |
| 0 | 0 | 0 | 0 | 1 |
| 0 | 1 | 0 | 0 | 0 |
| 0 | 1 | 0 | 0 | 0 |
| 0 | 0 | 1 | 1 | 1 |

METHOD FOR EMBEDDING NON-INTRUSIVE ENCODED DATA IN PRINTED MATTER AND SYSTEM FOR READING SAME

BACKGROUND OF THE INVENTION

Print monitoring systems are commonly used to monitor printed matter in some types of paper/sheet handling systems and to make certain control decisions based upon the character of the printed matter. The following is a list of a few common applications:

1. Print quality monitoring: The monitoring system detects the precision with which the printing system has formed the printed matter and/or the consistency with which the matter is printed across the entire paper. For example, in a laser printing system, the monitoring systems detect low-toner situations where the contrast of the printed matter has degraded unacceptably.

2. Digit control: Overnight package delivery systems, for example, typically use preprinted multi-layered shipping receipts that are filled out by the customer; the customer keeps one receipt, the package recipient receives a receipt with the package, and then typically, a few receipts are retained for the carrier's records.

Such receipt systems are typically printed with a package tracking number that is represented as an alpha-numeric sequence on the customer's and recipient's copies and encoded in a universal product code (UPC) or bar code symbol on at least one of the carrier's receipts. The carrier's package tracking system is based upon the presumption that the package tracking numbers are the same for each layer of the receipt. In such situations, print monitoring systems ensure that the package tracking numbers of each layer match during assembly of the receipt.

3. Sequence control: When mailing personalized advertisement materials and in all cases when mailing bills, it is necessary to ensure that all pages of the mailing insert are combined into the proper envelope. This is especially important in the case of confidential information, such as credit card or phone bills. Even if sheet transfer and handling error rates are low, the risk that a wrong bill will be sent to a customer is unacceptable thus requiring checking each page and the envelope prior to insertion.

Historically, sequence control has involved closely monitoring the printers, feeders, cutters, folders/accumulators, inserters, and stackers for paper jams or other error conditions. With proper coordination, the right materials generated by the printers can be placed into the correct envelopes or accumulated into the proper packets or publications.

Especially in the case of mailing sensitive material, print monitoring systems have been developed more recently to confirm the printed material contents prior to placement in an envelope. To enable monitoring, sequence control information is commonly placed into the printed matter, or implicit in it. For example, checks have separate identification numbers, bills have the customer account numbers at a predetermined locations. The print monitoring system can detect these identifiers and use them as sequence control information to ensure that all pages of a given bill for a account number are placed in the proper envelope and addressed to the proper customer and avoiding the inclusion of any extraneous bill pages.

More recently, with the introduction of production speed, low cost laser printing machines, mailed marketing material, brochures, and other materials have been personalized for a specific recipient, even in high volume printing jobs. In these cases, sequence control issues are important, and in many cases can be similarly critical due to confidentiality concerns and embarrassment caused by unintended recipients. Unfortunately, in this environment, the inclusion of explicit sequence control information on the printed matter is many times unacceptable. Formal letters and brochures will typically not include machine readable information at predicable locations to enable the print monitoring system to ensure that proper sequencing is being maintained.

Attempts have been made at placing non-intrusive information into printed matter. Glyph codes are one example. Information is typically encoded into glyph codes by modulating the orientation of optically detectable symbols or glyphs. Using such techniques, large amounts of information can be encoded into printed images for copy control or copyright tracking, for example.

SUMMARY OF THE INVENTION

Generally, however, glyph codes are not appropriate for print monitoring. The symbols can be placed into images. Not all printed matter has pictures on every page, especially in marketing material and printed matter in mailings. Moreover, the pictures may not reside at the same location for different jobs. Therefore, generic image capture devices that monitor for the glyph-based symbols must process the entire area of the printed matter, increasing the expense in both the image capturing device and the processing capability required.

The present invention is directed to non-intrusive data encoding technique. The technique is non-intrusive in the sense that the printed symbol is detectable upon close inspection, but is not apparent to the intended reviewer of the printed matter. In other embodiments, however, the symbol is not only not apparent but actually invisible to unaided inspection. A further advantage is that the symbol can be localized in the document, limiting the size of the image capture device required for detection and the amount of data that must be handled by the compute resources. Moreover, the symbol can be located in substantially the same location even between different printing runs of different printed matter. This feature can lower or eliminate the time required to recalibrate the image capture device's position relative to the printed matter.

In general, according to one aspect, the invention concerns printed matter. This printed matter has printed informational content. This refers to the content of a given document which is relevant to the intended reviewer, e.g., the printed text of the letter or pictures. According to the invention, the printed matter also, however, comprises a print control symbol. This symbol is located at a predetermined position on the printed matter, which is separated from the printed informational content. The print control symbol is hidden such that it is not apparent to a reviewer of the printed matter and encodes information concerning the printed matter such as sequencing information, which is relevant to the printing system during printing and mailing, for example.

Since the print control symbol is separated from the printed informational content, the printed informational content can comprise text-only, for example. This distinguishes it from glyph-based encoding techniques.

In specific embodiments, the print control symbol comprises a series of bit characters. Preferably, they are organized into a two-dimensional matrix. The presence absence of bit characters in slots of this matrix encode binary data.

In order to minimize the visual impact of the print control symbol, the bit characters are as small as possible, i.e., formed from only a few pels of the printer, with imaging capability being the limitation on the minimum size of the characters. In one example, each character consists of one pel in a 300 dots per inch laser printer (DPI). In a 400 DPI printer, the characters consist of four pels in a 2×2 square matrix; and in a 600 DPI printer, the bit characters can include nine pels in a 3×3 square matrix. Another way, with current, commercially feasible imaging equipment, the minimum size of the characters is about 0.1 millimeters (mm), specifically, 0.0825 mm. The minimum spacing between characters is about 0.2–0.3 mm, specifically, 0.25 mm. The variation in relative spacing is about 15%.

In any case, to ensure that they are not apparent to the user, the characters should comprise less than nine adjacent pels of the printer. Further, in order to enable accurate decoding by the print monitoring system, the print control symbol preferably comprises data bit characters for encoding not only the print sequencing information, but also error correction bit information.

These points aside, in other applications, the principles of the invention are used even where the print control symbol is apparent to the reader. This allows much larger bit characters.

In general, according to another aspect, the invention also features a printing method. This method comprises generating information concerning sequencing of printed matter from a printer. During printing, the informational content of the printed matter is printed by the printer along with non-apparent print control symbols, at predetermined positions on the printed matter and separated from the printed informational content, to encode sequencing information.

In general, according to still another aspect, the information also features a printing system, having sequence monitoring. This system comprises a printer that generates printed matter that includes printed informational content and a print control symbol. A printed matter monitoring system includes an image capture device and controller. The image capture device reads at least the print control symbol from the printed matter from the printer and the controller decodes data encoded in the print control system and makes sequencing decisions based upon that decoded data.

In preferred embodiments, the printer prints the print control symbol at predetermined positions on the printed matter. These positions are separated from the informational content of the printed matter, preferably. Further, the print control symbol is preferably not apparent, or invisible, to the user.

Finally, according to another aspect of the invention, the invention also features a print monitoring method. This method comprises generating printed matter including printed informational content and a print control symbol. The print control symbol is then detected and decoded. Sequencing of the printed matter is then performed based upon the information in the print control symbol.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the drawings, like reference characters refer to the same parts throughout the different views. The drawings are not necessarily to scale, emphasis instead being placed upon illustrating the principles of the invention. Of the drawings.

DETAILED DESCRIPTION OF THE INVENTION

Figure 1:
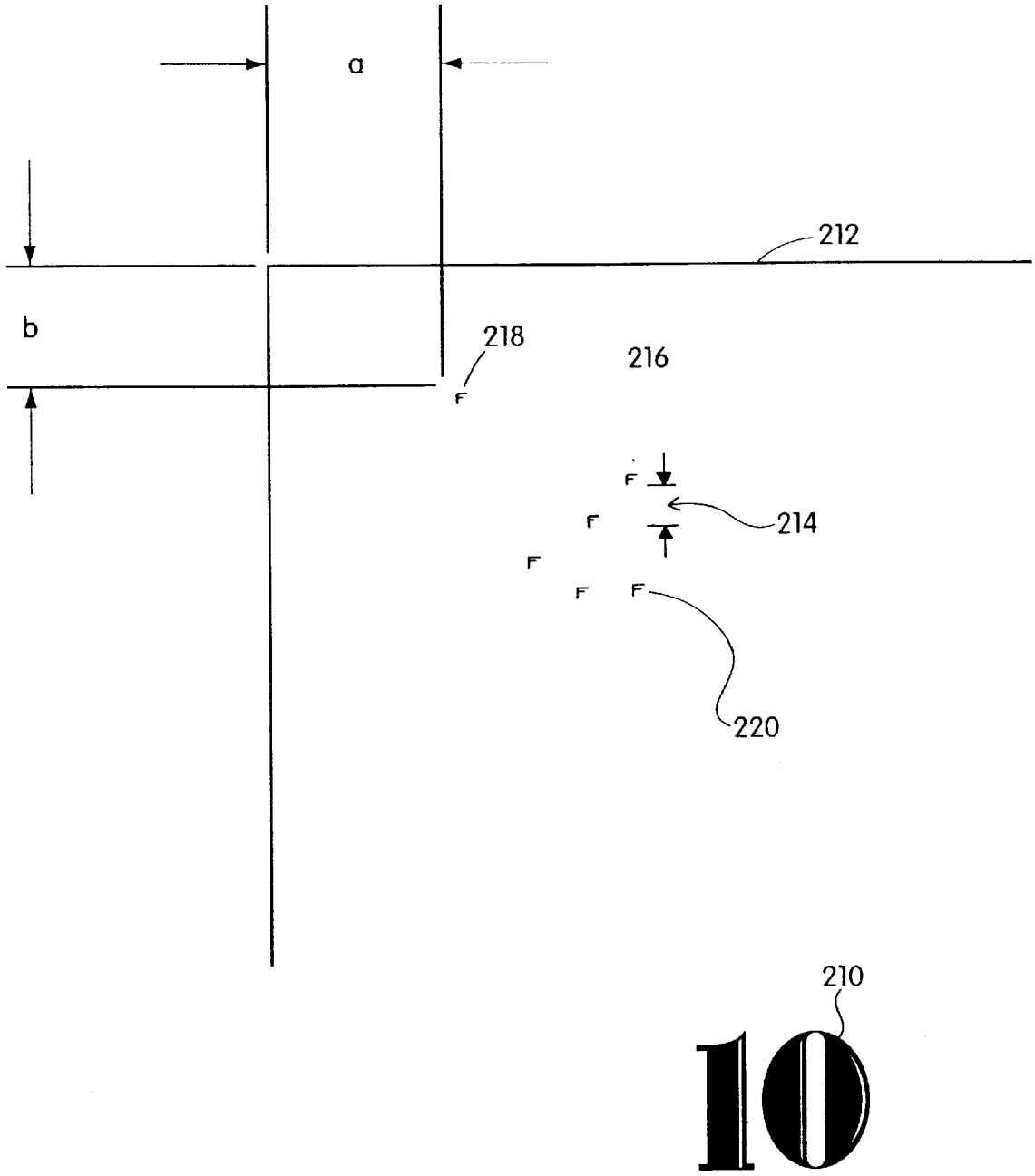
FIG. 1 is a scale drawing showing the positioning of the print control symbol on a page of printed matter according to the present invention.

FIG. 1 shows an example of printed matter, generated by a 600 DPI printer, which is configured according to the principles of the present invention. Specifically, it comprises printed informational content 210. This can be text or image content which is located as customary on page 212. Also, on the printed matter is print control symbol 214. The symbol 214 is preferably located in a predetermine position on the page 212. In the illustrated embodiment, it is located in the upper left hand corner. While the predetermined location of the print control signal is not absolutely necessary, it is important in many applications since any print monitoring system scanning for the print control signal can find it quickly based upon its predetermined position.

Preferably, the print control symbol 214 is separated from the printed informational content 210. This feature distinguishes it from glyph codes, for example, which are actually incorporated into the printed informational content. In the preferred embodiment, there is approximately 0.250 inches of minimum clear space buffer separating the print control symbol 214 from any printed informational content 210. This allows any print monitoring system to quickly and clearly distinguish it from the informational content. Further, in one specific embodiment, it is located approximately a=0.75 inches from the left edge of the paper 212 and b=0.50 inches from the top edge of the paper 212.

The minimum size for bit characters 216, which comprise the print control symbol 214, is approximately 0.0033 inches (in) (0.0825 mm). The minimum spacing between centers of adjacent bit characters is 0.01 in (0.25 mm). In the present case, the size is 0.005 in, and the spacing is 0.015 in.

The illustrated example of the print control symbol 214 has 4 rows and 5 columns of bit characters slots. The appearance or not of a bit character 216 at each potential position at the intersection of a row and column encodes binary data describing print and/or error correction information.

Figures 2, 3:
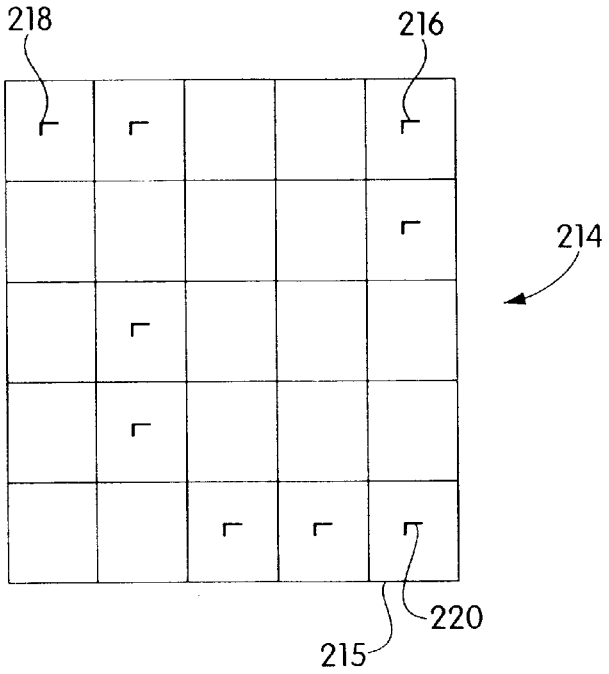
FIG. 2 is a diagram illustrating the bit character slots in the print control symbol according to the present invention.
FIG. 3 shows the binary values of the slots in the print control symbol.

FIG. 2 is a schematic view of the print control symbol 214 having five rows and five columns in the bit character matrix. In the preferred embodiment, the presence of a bit character in a location or slot of the matrix is assigned a binary value of "1" and the absence is assigned the binary value "0" as illustrated in the decoded matrix of FIG. 3.

In the preferred embodiment, the upper, left-most bit character 218 and the bottom, right-most bit character 220 are always present in the matrix of the print control symbol. This two-bit character pattern is used for frame reference to define the upper left and bottom right corners for a rectangular frame during detection in print monitoring. Note that the grid 215 of the matrix is shown in FIG. 2 for the purposes of explanation only and is not printed. In the preferred embodiment, the matrix of bit characters is framed by clear space as shown in FIG. 1 to maximize the degree to which the print control symbol is not apparent to the reviewer of the material.

The following illustrates the slot positions for an arbitrarily sized matrix:

$$\begin{matrix} a_{1,1} & a_{1,2} & \cdots & a_{1,n-1} & a_{1,n} \\ a_{2,1} & \cdots & \cdots & a_{2,n-1} & a_{2,n} \\ \vdots & & & & \\ a_{m-1,1} & a_{m-1,2} & \cdots & a_{m-1,n-1} & a_{m-1,n} \\ a_{m,1} & a_{m,2} & \cdots & a_{m,n-1} & a_{m,n} \end{matrix}$$

As mentioned, slots elements $a_{1,1}$ and $a_{m,n}$ are always "1" or contain the bit characters. This is the frame dot-pattern. Slots $a_{1,n}$, $a_{2,n}$, . . . , and an are odd parity check elements in rows. These will be set to make every row have an odd number of 1's. Similarly, slots $a_{m,1}$, $a_{m,2}$, . . . , and $a_{m,n-1}$ are odd parity check elements in columns. All other slots are kernel elements that are used for encoding a number plus a check digit. The total number of kernel coding slots is $(m-1)\times(n-1)-1$.

The kernel elements in the symbol matrix are used for encoding numeric data plus a check digit. In one embodiment, a modulo-10 remainder is the check digit. There are four elements in the kernel that are assigned for encoding the check digit for this symbol. As a result, there are $(m-1)\times(n-1)-1-4=(m-1)\times(n-1)-5$ elements left for encoding a number.

Preferably, the encoding of a number and the check digit follows the binary coding system rule, assuming each of the matrix slots represents a bit. The order of the arrangement of the elements is from left to right and from top to bottom; upper-left element takes the position of most significant bit (MSB) and bottom-right is least significant bit (LSB).

Assume there are N+1 kernel coding slots in a symbol which in order of N~0, i.e., N, N−1, N−2, . . . , N-k, . . . , 1, 0, where bit N is element $a_{1,2}$ and element $a_{m-1,n-1}$ is bit 0. Then the positions of the slots for coding a check digit are defined in this way: bit-0 is at position 0 (element $a_{m-1,n-1}$), bit-1 is at position (N+1)/3, bit-2 is at position 2(N+1)/3, and bit-3 is located at N (i.e., $a_{1,2}$). For example, in a 4×4 matrix, N=7, the check digit bits position at bit-3~bit-0=7,4,2,0. For a check digit 6, its binary value is "0110". If N=7, we can encode it into a bit data stream as "0**1*1*0" (from MSB to LSB), where '*' belongs to the number to be encoded in the symbol. In this example, assume the number is 6 and the check digit is 6. Its binary value is also "0110". Filling the data bits into the stream, the real encoded stream is "00111100". For a certain-sized symbol, the check digit bit positions are located at fixed positions according to the above rule.

The size of the symbol 214 is preferably adapted to the application. To reduce the coding redundancy, the size of the symbol matrix is designed with a minimum set of available kernel coding elements to encode the maximum number plus a check digit that is needed in the particular application. This reduces its detectability by the reviewer.

A typical symbol 214 is designed as a 5×5 matrix. The total number of elements within this matrix is 25 and that of the kernel coding elements is 15=(4×4−1). With the 4 elements reserved for check digit removed, the number of available coding elements is 11. It can encode the number from 0 to 2047 with their check digits.

To encode a numeric data in a 5×5 symbol, first of all, we need calculate the bit positions for the check digit. In this case, N=14. Then the positions of the check digit bit elements are 14, 10, 5, and 0. Below, they are elements a, e, j, and p.

| | | | | |
|---|---|---|---|---|
| 1 | a | b | c | $x_1$ |
| d | e | f | g | $x_2$ |
| h | i | j | k | $x_3$ |
| l | m | n | p | $x_4$ |
| $y_1$ | $y_2$ | $y_3$ | $y_4$ | 1 |

According to above calculation, elements 'bcdfghiklmn' are the bits used for encoding a number. In binary system, 'b' is MSB and 'n' is the LSB for the coded number and 'a' is MSB and 'p'is LSB for the check digit.

For example, the binary code for the number $100_{10}$, is '1100100'. Since the total number of elements dedicated to encode the number is 11, we add leading '0' to this bit stream as '00001100100'. Since the Modulo-10 remainder of the number 100 is 0, the check digit is 0, i.e., '0000' in binary system. Then, to code it into the matrix, the individual elements are: a=0, b=0, c=0, d=0, e=0, f=0, g=1, h=1, i=0, j=0, k=0, l=0 m=0, n=0, and p=0 To complete the matrix, slots $x_1$, $x_2$, $x_3$, $x_4$, $y_1$, $y_2$, $y_3$, and $y_3$, are filled. First, the parity of each row is reviewed. The $1_{st}$ row has one 1's (a=b=c=0); it is odd number of 1's, then the element $x_1$ should be 0 to make the number of 1's in this row remain odd. Similarly, $x_2=x_3=0$, and $x_4=0$. Then, for each column, a similar parity check is performed. Thus, $y_1=0$, $y_2=1$, $y_3=1$, and $y_4=0$.

Alternatively, a circular parity check could be used if the paper is of a low quality or if more decoding accuracy is required. The combination of the parity check and the check digits allows correction if noise or some paper defect results in a bit character being missed or interpreting the noise as the character where none were printed.

Figure 4:
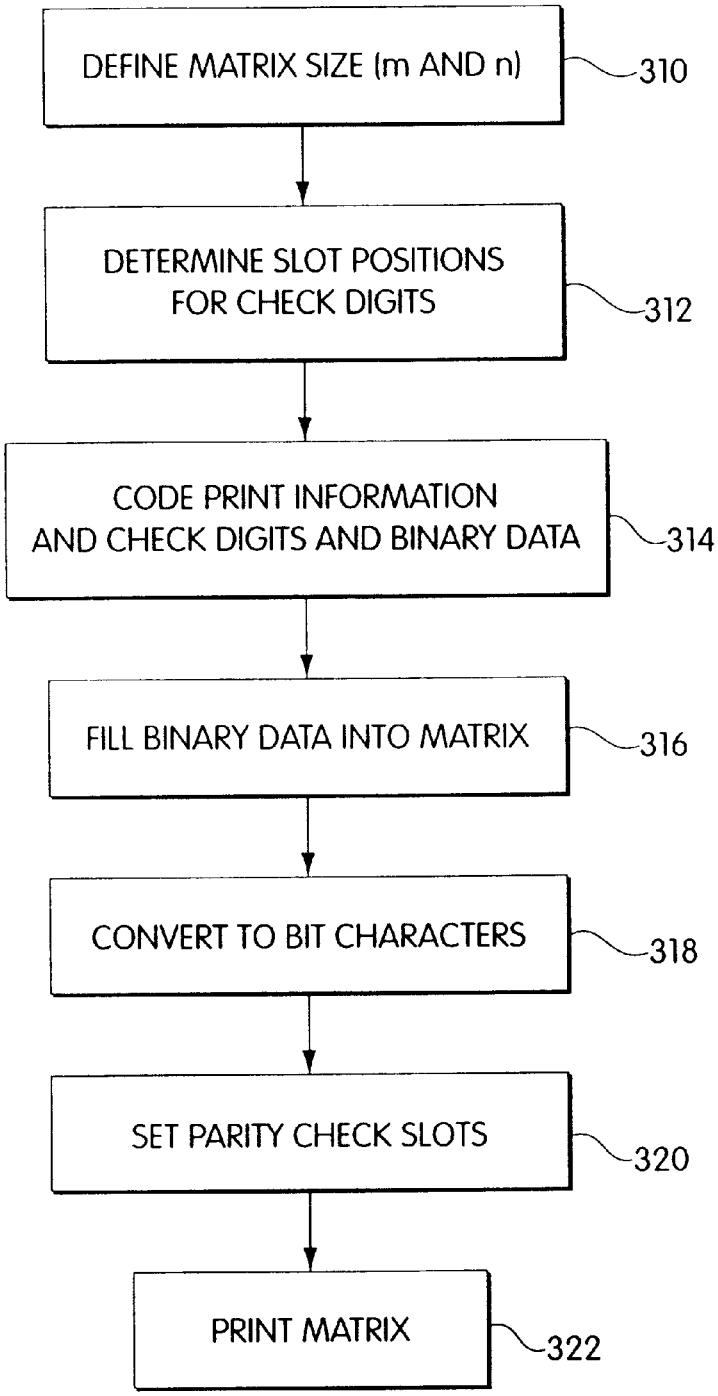
FIG. 4 is a process diagram showing the method for generating the print control symbol according to the invention.

FIG. 4 is a process diagram illustrating the generation of the print control symbol.

Specifically, in step 310, the size of the matrix of the print control symbol 214 is defined. The amount of data that is to be encoded in the symbol is assessed. The maximum amount of data then defines the size of the symbol, the number of its rows and columns. Preferably, the matrix should be kept as small as possible to make it as unapparent as possible to the reviewer of the printed matter.

In step 312, the slot positions for the check digits for the kernel slots are determined. Then, the print information and check digits are encoded as binary data in step 314.

At this stage, the matrix is filled with 1's and 0's in step 316. In the preferred embodiment, the 1's are converted to the bit characters in the matrix; the 0's are converted to open areas, in step 318. In step 320, the parity check slots are set. Specifically, for each row, the parity check slots are set so that there is an odd number of bit characters in each row.

This is also performed for the columns. Finally, in step 322, the matrix is printed as the print control character on the printed matter.

Printing System

Figure 5:
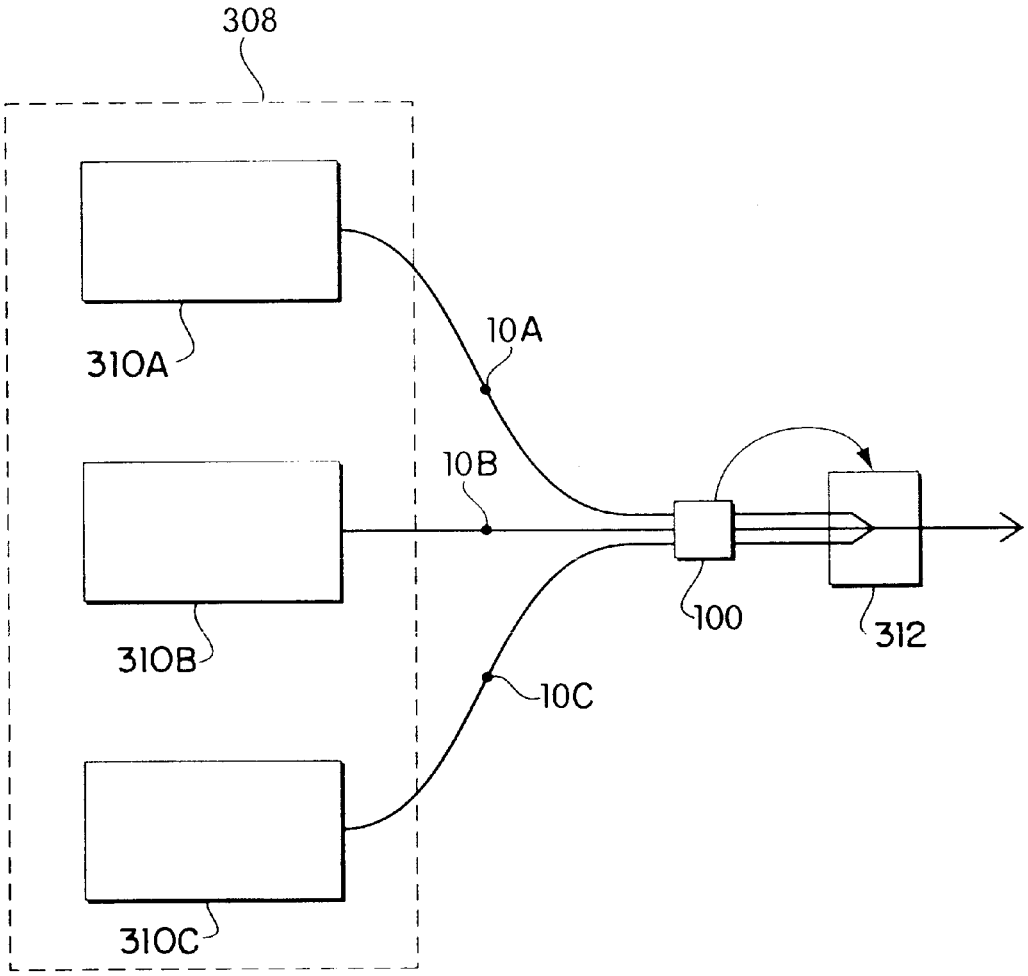
FIG. 5 shows a printing system to which principles of the present invention are applied.

FIG. 5 is a block diagram showing a printing system having sequence monitoring capabilities according to the principles of the present invention. Specifically, the printing system comprises at least one, typically multiple printers 310A–310C. Each printer generates a stream of printed matter 10A–10C. One or all of these streams of printed matter have been imprinted with the print control symbol 214 according to the present invention. In the preferred embodiment, the print control symbols encode sequencing information that correlates the printed matter from each of the separate printers, such as printed envelopes from one printer and a letter or other contents from another printer. In one specific example, the streams pass through a print monitoring system 100, which detects the print control symbols in each stream of printed matter 10A–10C. The print monitoring system then uses the information gained from analyzing the print control symbols from each stream to control a printed matter manipulator 312 that uses sequencing information, for example, from the print monitoring system 100 to organize the streams of printed matter relative to each other. In one example, the manipulator 312 could be cutter, feeder, inserter, or accumulator/folder for combining bills into the envelopes. In other examples, it could be a binding machine for combining the streams into a single multi-page document.

Figure 6:
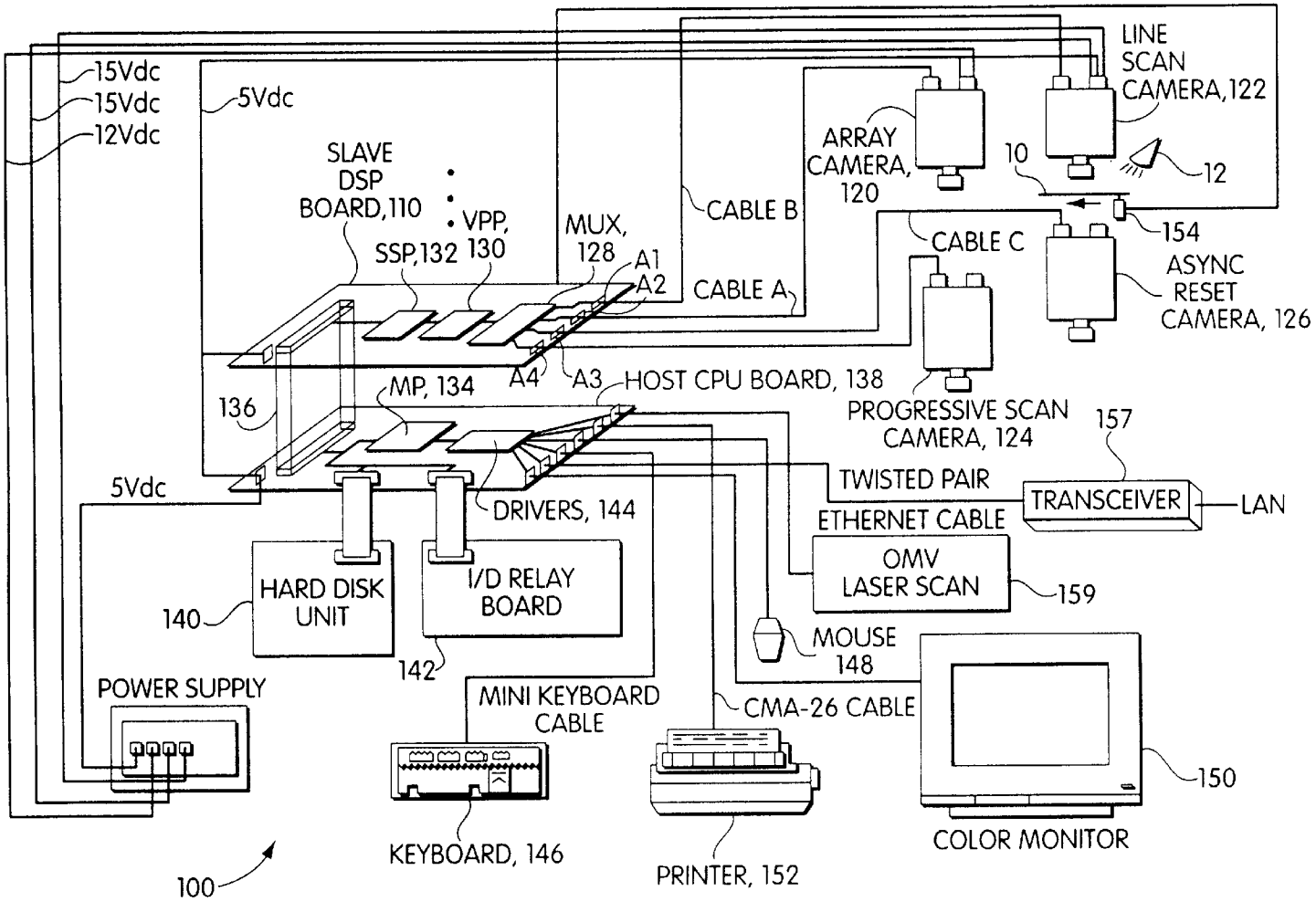
FIG. 6 is a block diagram illustrating a print monitoring system useful for carrying out the present invention.

FIG. 6 is a schematic block diagram illustrating the general organization of the print monitoring system 100. The system is further disclosed in U.S. patent application Ser. No. 09/016,001, filed Jan. 30, 1998, entitled PRINT MONITORING SYSTEM AND METHOD USING SLAVE SIGNAL PROCESSOR/MASTER PROCESSOR ARRANGEMENT, the contents of which are incorporated herein in their entirety by this reference.

In the preferred embodiment, each slave processor (DSP) board 110 has multiple, four for example, video input ports A1, A2, A3, A4. Each video signal port A1–A4 has the capability to support its own video capture device. As illustrated, potential video capture devices include array cameras 120, line camera 122, progressive scan cameras 124, and asynchronous reset cameras 126.

In order to time image acquisitions by the cameras, trigger device 154 is used to detect the movement of the printed matter 10. The trigger device 154 takes a number of different configurations depending on the application and the event to be detected. In one case, it detects the beginning of a sheet of paper using an optical or probe sensor. The signal processor 132 then times a delay until the symbols of interest are under the camera before signaling the beginning of an image capture event. In other cases, the trigger device 154 is used to detect symbols on the printed matter such as lines at predetermined intervals or movements of the paper handling equipment using optical or mechanical encoders, for example.

On the slave board 110, an analog multiplexor 128 is used to select the video signal from one of the video input ports A1–A4. The selected video signal is presented to a video preprocessor 130 that converts the video signal into a form that is capable of being sampled at a digital signal port of a digital signal processor 132. Specifically, the video preprocessor 130 low pass filters the video signal to compensate for any uneven illumination at the video capture device 120–126 by printed matter illuminator 12 and level adjusts the video signal by thresholding it to a signal level appropriate for receipt at the signal processor's digital signal port.

The signal processor 132 identifies the target print control symbols in the captured video signal by reference to the predetermined position for the symbols and the frame bit characters 218, 20.

As suggested by the FIG. 6, additional slave DSP boards 110 can be attached to the ISA bus 136. For example, in one implementation, up to four separate slave DSP boards 110 are connected to the host central processing unit (CPU) board 138 via extensions to the bus 136 to monitor coordinate and sequence multiple streams of printed matter 10A–10C.

In the preferred embodiment, the master processor 134 is an Intel-brand 80586 industrial-grade CPU. It connects to a hard disk unit 140, input/output (I/O) relay board 142, and memory via bus 136. In the preferred embodiment, through its drivers 144, it receives user commands from a keyboard 146 and mouse 148. It presents data to the operator via color monitor 150 and printer 152. In a preferred implementation, the monitor 150 preferably has a touch screen to enable operator control without the necessity for the keyboard 146 and mouse 148. In the preferred embodiment, the system also has a network interface card (NIC) 157 connecting the CPU board 138 to a local area network (LAN) to enable remote control, monitoring, and data logging.

Since the master processor 134 is not burdened with image processing, this being performed by the slave processors 132, the host CPU board 138 has the capability to receive print monitoring data via its digital input ports, such as the serial port. The data is generated by a laser bar code scanner and/or optical/magnetic reader 194. This provides the ability to acquire additional data directly by the CPU 134 in addition to that received through the slave DSP boards 110.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method for encoding sequencing information on printed matter having informational content imprinted thereon, said method comprising the steps of:

providing sequencing information about the printed matter, wherein the sequencing information identifies where the printed matter fits into a sequence; and printing, at a predetermined position on the printed matter, a non-apparent print control symbol that encodes the sequencing information, the predetermined position being separated from the printed informational content.

2. A printing method as recited in claim 1, further comprising the step of reading the print control symbol with a print monitoring system to ensure proper sequencing of the printed matter.

3. A printing method as recited in claim 1, further comprising the step of forming the print control symbol from a series of bit characters.

4. A printing method as recited in claim 3, further comprising the step of generating a spatial distribution of bit characters by printing the series of bit characters in a plurality of slots arranged as a two-dimensional matrix.

5. A printing method as recited in claim 4, further comprising the step of encoding binary data by the spatial distribution of bit characters in the slots of the matrix.

6. A printing method as recited in claim 5, wherein the print control symbol encodes information selected from a group consisting of error correction information and error detection information.

7. A printing method as recited in claim 1, further comprising the step of encoding binary data by the spatial distribution of bit characters in locations within the print control symbol.

8. A printing method as recited in claim 7, further comprising the step of forming the bit characters from fewer than nine adjacent pels of a printer.

9. A printing method as recited in claim 1, wherein the print control symbol encodes information selected from a group consisting of error correction information and error detection information.

10. A printing system comprising a printer that generates printed matter including printed informational content and a print control symbol; and an image capture device configured to read at least the print control symbol from the printed matter; and a controller in communication with the image capture device that decodes data encoded in the print control symbol and makes sequencing decisions based on the data.

11. A printing system as recited in claim 10, wherein the printer further comprises means for printing the print control symbol in a predetermined position on the printed matter.

12. A printing system as recited in claim 10, wherein the printer further comprises means for printing the print control symbol separated from the printed informational content on the printed matter.

13. A printing system as recited in claim 10, wherein the printer comprises means for printing the print control symbol in a form that is not apparent to a reviewer of the printed matter.

14. A printing system as recited in claim 10, wherein the printer comprises means for printing a series of bit characters representative of the print control symbol.

15. A printing system as recited in claim 14, wherein the printer further comprises means for generating a spatial distribution of bit characters in a two-dimensional matrix.

16. A printing system as recited in claim 15, wherein the printer comprises means for encoding binary data as a spatial distribution of bit characters in slots of the matrix.

17. A printing system as recited in claim 16, wherein the printer further comprises means for encoding print and error correction information in the print control symbol.

18. A printing system as recited in claim 10, wherein the printer further comprises means for encoding binary data as a spatial distribution of bit characters in locations within the print control symbol.

19. A printing system as recited in claim 10, wherein the printer comprises means for forming the bit characters from the number of pels of the printer that are necessary to reach a threshold of visibility for the image capture device.

20. A printing system as recited in claim 10, wherein the printer comprises means for forming the bit characters from fewer than nine adjacent pels of the printer.

21. A printing system as recited in claim 10, wherein the printer comprises means for encoding print and error correction bit information as a spatial distribution of bit characters in the print control symbol.

22. A method for monitoring the output of a printer, the output being printed matter including a non-apparent print control symbol having sequencing information encoded therein, said method comprising the steps of:

detecting a presence of the non-apparent print control symbol on the printed matter;

decoding the non-apparent print control symbol to retrieve the sequencing information encoded therein; and sequencing the printed matter on the basis of the sequencing information from the non-apparent print control symbol.

23. A print monitoring method as recited in claim 22, wherein the step of detecting the print control symbol comprises the step of monitoring a predetermined position on the printed matter.

24. A print monitoring method as recited in claim 22, wherein the step of detecting the print control symbol comprises the step of monitoring a position separated from printed informational content on the printed matter.

25. A print monitoring method as recited in claim 22, wherein the step of detecting the print control symbol comprises the step of detecting a symbol printed in a form that is not apparent to a reviewer of the printed matter.

26. A print monitoring method as recited in claim 22, wherein the step of detecting the print control symbol comprises the step of detecting a series of bit characters.

27. A print monitoring method as recited in claim 26, wherein the step of detecting the series of bit characters comprises the step of detecting bit characters spatially distributed in a plurality of slots arranged as a two-dimensional matrix.

28. A print monitoring method as recited in claim 27, wherein the step of decoding the print control symbol comprises the step of interpreting the spatial distribution of bit characters in the slots of the matrix as binary data.

29. A print monitoring method as recited in claim 28, wherein the step of decoding the print control symbol further comprises the step of interpreting the spatial distribution of bit characters as encoded print and error correction information.

30. A print monitoring method as recited in claim 22, wherein the step of decoding the print control symbol comprises the step of interpreting a spatial distribution of bit characters in locations within the print control symbol.

* * * * *